US007918000B2

(12) United States Patent
Hein et al.

(10) Patent No.: US 7,918,000 B2
(45) Date of Patent: Apr. 5, 2011

(54) ARTICLE FOR HOLDING AN OBJECT

(75) Inventors: John Hein, Ilkley (GB); Peter Antony Farrar, Menston (GB)

(73) Assignee: Dubois Limited (GB)

( * ) Notice: Subject to any disclaimer, the term of this patent is extended or adjusted under 35 U.S.C. 154(b) by 209 days.

(21) Appl. No.: 11/569,786

(22) PCT Filed: May 27, 2005

(86) PCT No.: PCT/GB2005/002111
§ 371 (c)(1),
(2), (4) Date: Sep. 3, 2008

(87) PCT Pub. No.: WO2007/071887
PCT Pub. Date: Jun. 28, 2007

(65) Prior Publication Data

US 2008/0307615 A1 Dec. 18, 2008

(30) Foreign Application Priority Data

May 29, 2004 (GB) ..... 0412116.6

(51) Int. Cl.
*B42F 1/00* (2006.01)

(52) U.S. Cl. ..... 24/67.11; 24/545; 206/232

(58) Field of Classification Search ..... 24/555, 24/67.11, 67.9, 545, 563, 67.3, 546, 556, 24/561, 562; 206/232
See application file for complete search history.

(56) References Cited

U.S. PATENT DOCUMENTS

| | | | | |
|---|---|---|---|---|
| 857,488 | A * | 6/1907 | Rosenthal | 24/710.5 |
| 2,546,470 | A | 3/1951 | Mueller | |
| 4,083,523 | A | 4/1978 | Fisher | |
| 4,369,946 | A * | 1/1983 | Palmer et al. | 248/74.2 |
| 4,401,323 | A | 8/1983 | Rex | |
| 4,681,221 | A | 7/1987 | Chickanosky et al. | |
| 5,263,580 | A | 11/1993 | Ciba et al. | |
| 5,819,379 | A | 10/1998 | Van Hout et al. | |
| 6,443,300 | B1 | 9/2002 | Gelardi | |
| 6,581,766 | B2 | 6/2003 | Hui et al. | |
| 2001/0021167 | A1 | 9/2001 | Kutaragi et al. | |
| 2002/0027358 | A1 | 3/2002 | Peppers | |
| 2003/0038042 | A1 | 2/2003 | Nagata et al. | |

FOREIGN PATENT DOCUMENTS

DE 4036882 C1 6/1992

(Continued)

OTHER PUBLICATIONS

United Kingdom Search Report dated Oct. 20, 2004, United Kingdom Application No. GB0412115.8.

(Continued)

*Primary Examiner* — James R Brittain
(74) *Attorney, Agent, or Firm* — McDermott Will & Emery LLP

(57) ABSTRACT

A clip for holding an object, such as a literature booklet, comprises first (23) and second (25) resilient parts, the first part adapted to hold an object having a first thickness and the second part adapted to hold an object having a second thickness, the first thickness being greater than the second thickness. Consequently, the clip can hold a range of thickness of literature booklets or other objects. The clip may be part of an article, such as a container for compact discs or DVD's.

16 Claims, 3 Drawing Sheets

FOREIGN PATENT DOCUMENTS

| | | | |
|---|---|---|---|
| EP | 0575026 | A1 | 12/1993 |
| EP | 0729897 | | 9/1996 |
| EP | 1128387 | | 8/2001 |
| GB | 0215397 | | 5/1924 |
| GB | 0324341 | | 1/1930 |
| GB | 738375 | | 10/1955 |
| GB | 741575 | | 12/1955 |
| GB | 2272889 | | 6/1994 |
| WO | WO-02/39451 | | 5/2002 |
| WO | WO-03/051747 | | 6/2003 |
| WO | WO-2004/005654 | | 1/2004 |
| WO | WO-2004/024600 | | 3/2004 |
| WO | WO-2005/040531 | | 5/2005 |
| WO | WO-2005/119684 | | 12/2005 |

OTHER PUBLICATIONS

International Search Report dated Oct. 21, 2005, International Application No. PCT/GB2005/002119.

European Exam Report, Nov. 27, 2008.

United Kingdom Exam Report, Dec. 19, 2007.

* cited by examiner

ARTICLE FOR HOLDING AN OBJECT

The present invention relates generally to containers and other articles for holding objects. The invention has particular relevance to containers and other articles for holding objects such as data storage media, including compact discs, DVD discs, tapes and cartridges (e.g. computer cartridges). The invention is not, however, limited to the field of data storage media, but is applicable generally to all types of containers and other articles for holding objects.

Recorded data, including audio data (e.g. music) and audio-visual data (e.g. films, television programs, or computer software, including computer games) are often supplied with literature, for example in the form of booklets. Such literature may provide information concerning the content of the data storage media, for example information concerning audio or audio-visual content, or instructions concerning computer software. With the ever-increasing range of such content, the range of literature booklet thicknesses has grown, to encompass slim booklets of a small number of pages (or even one or two sheets of paper), to thicker booklets of many pages. There is consequently a need for the containers and other articles holding the storage media and the accompanying literature to hold any thickness of booklet within a large range of thicknesses.

A media storage container including a literature clip for holding different thicknesses of literature booklets is proposed in international patent application WO 03/051747. This document discloses a clip that is able to move from a first position in which the clip is adapted to hold a relatively thin booklet, to a second position in which the clip is adapted to a hold a relatively thick booklet. The clip is moved from its first position to its second position and latched in place with respect to a wall of the container when in the second position.

The present invention seeks to provide an improved clip, especially an improved literature clip, and an article, for example a container, including the clip.

Accordingly, a first aspect of the invention provides a clip for holding an object, the clip comprising first and second resilient parts, the first part adapted to hold an object having a first thickness and the second part adapted to hold an object having a second thickness, the first thickness being greater than the second thickness.

A second aspect of the invention provides an article for holding an object, the article including at least one clip according to the first aspect of the invention. Preferably the article is a container.

The article according to the invention preferably is a container, e.g. for data storage media.

The clip according to the invention preferably is a literature clip, and the object preferably is a literature booklet (which term includes single or double sheets of paper). The clip preferably can hold single or double sheets of paper, or very slim booklets of thicknesses of 1-2 mm. The literature clip can also hold thicker booklets, preferably of thicknesses up to 8 mm, and more preferably up to 10 mm or 15 mm, or greater.

In preferred embodiments of the invention, the second part of the clip extends from the first part, preferably from an end region (e.g. substantially an end) of the first part of the clip. The end region of the first part of the clip preferably is a free end region thereof. The second part of the clip preferably has a width no greater than (and preferably less than) the width of the first part of the clip, and preferably the second part of the clip does not project beyond the width of the first part of the clip. For example, the second part of the clip may correspond to an aperture in the first part of the clip (and, for example, the second part may, or may not, be formed by deforming a portion of the first part of the clip away from the reminder of the first part). Advantageously, the first and second parts may extend in generally opposing directions to each other.

The clip preferably is attached to the remainder of the article via the first part of the clip. The clip preferably is not attached to the remainder of the article via the second part of the clip. It is preferred that the second part, and at least a portion of the first part, of the clip, extend over a plane defining a surface of the article. Advantageously, the portion of the first part of the clip may comprise a cantilever extending over the surface of the article. Preferably the surface of the article adjacent to the clip is substantially flat, and more preferably substantially free from protrusions, e.g. to allow a booklet or other article to slide into, and out of, engagement with the clip along the surface of the article. Preferably at least a portion of the second part of the clip extends substantially parallel to the plane of the surface of the article.

To hold an object having a second thickness, the second part preferably moves resiliently with respect to the first part. To hold an object having a first thickness, the first and second parts preferably move resiliently as a unit.

The clip and/or the article preferably is/are formed from a plastics material, for example polypropylene or polyethylene. Preferably the clip and/or the article is/are moulded, for example by injection moulding.

Preferably the (or each) clip of an article according to the injection is integrally formed with the remainder of the article, for example by moulding.

Preferred and optional features of the invention are described below and in the dependent claims.

Some embodiments of the invention will now be described, by way of example, with reference to the accompanying drawings, of which:

Figure 1:
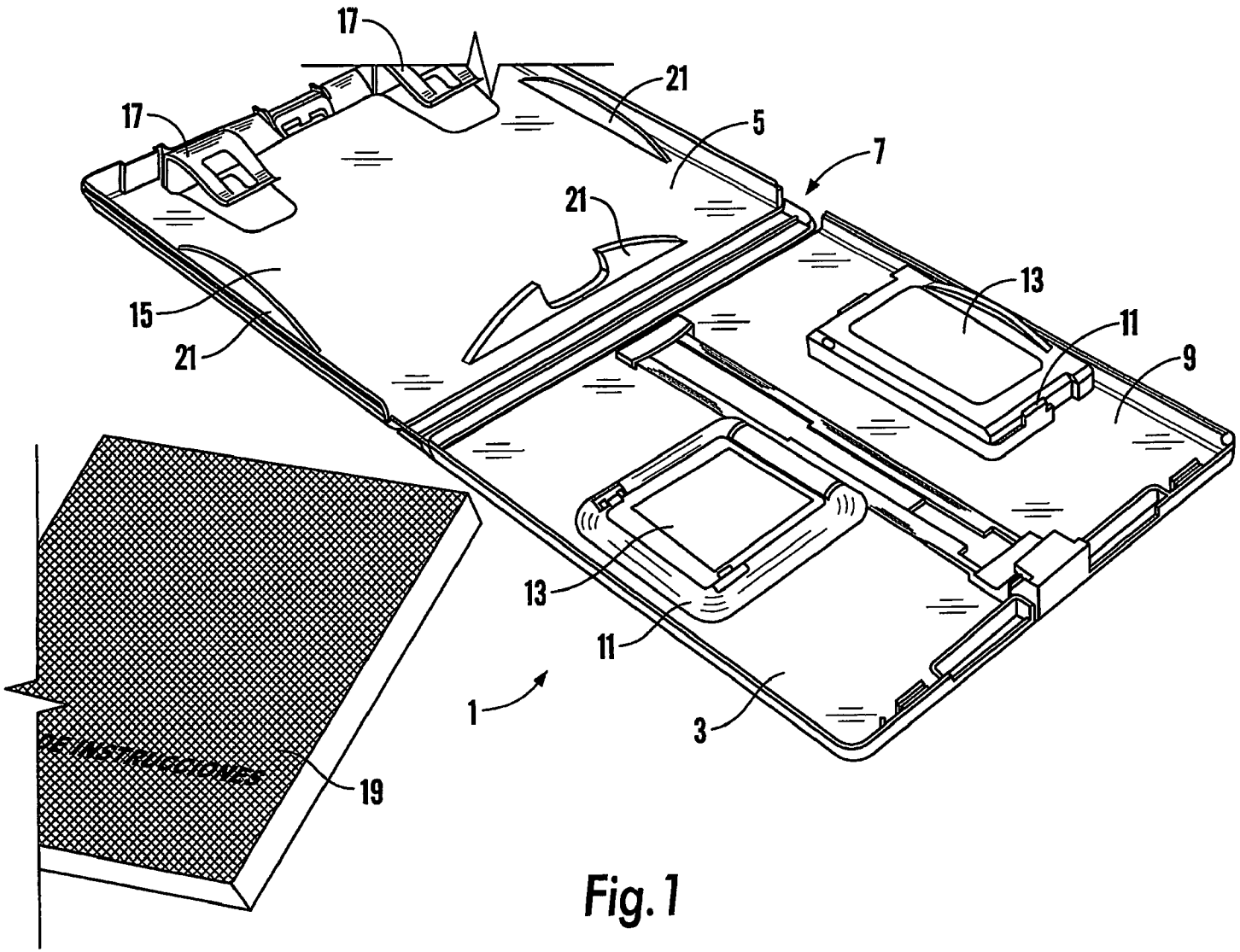
FIG. 1 shows an article according to the invention in the form of a container for data storage media.

FIG. 1 shows an embodiment of an article 1 according to the invention, in the form of a container for data storage media. The container 1 comprises a base 3, a lid 5, and a hinge arrangement 7 by which the base and the lid may be brought together to close the container. A surface 9 of the base 3, which is situated inside the container when the container is closed, includes retaining devices 11 for computer games cartridges 13. (Alternatively or additionally, the container could include retaining devices for compact discs, DVD discs, tapes, or other data storage media.)

A surface 15 of the lid 5 of the container 1, which is situated inside the container when the container is closed, includes a plurality (two as drawn) of clips 17 according to the invention. The clips 17 are literature clips for holding a literature booklet, such as the booklet 19. By means of the clips 17, together with retaining members 21 (in the form of upstanding wall features) also provided on the surface 15, the booklet 19 may be held on the interior surface 15 of the lid 5 of the container. The booklet 19 is held in place on the interior surface of the lid of the container both when the container is closed, and when the container is opened, until it is manually removed from the clips 17 and from the peripheral upstanding retaining members 21.

Figure 2:
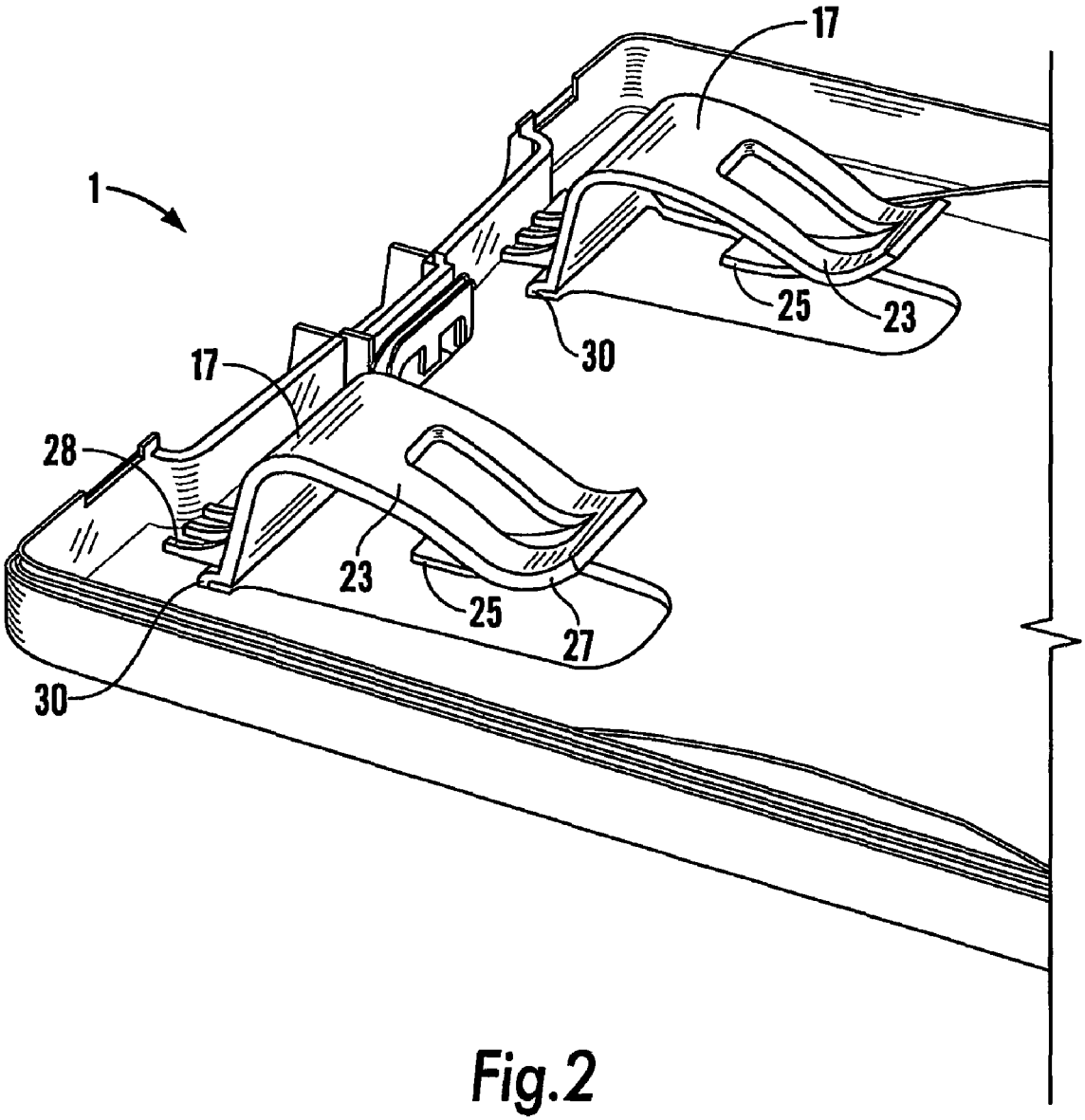
FIG. 2 shows a detail of an article according to the invention, similar to that of FIG. 1.

A detail of a container 1 according to the invention, which is similar to that shown in FIG. 1 is shown in FIG. 2. The detail shows two literature clips 17 according to the invention, provided on the interior surface 15 of the lid of the container.

More specifically, each clip 17 comprises a first resilient part 23 and a second resilient part 25, both parts extending over the plane of the surface 15, and at least the first part 23 spaced apart from the plane of the surface. (The clips 17 actually extend over gaps provided in the surface 15, formed when the container is moulded.) Each clip 17 is attached to the remainder of the container 1 via the first part 23 of the clip, and not via the second part 25 of the clip. Instead, the second part 25 of the clip extends from the first part 23, and specifically extends from a free end region 27 of the first part 23 of the clip, in a direction generally opposing the direction in which the first part 23 extends. The end region 27 is in the form of an upwardly-curved "lead-in" of the clip, which facilitates the smooth insertion of a literature booklet (or other article) into the clip. The lead-in 27 is a lead-in for both the first part 23 and the second part 25.

A first portion 23*a* (as indicated schematically in FIG. 3) of the first part 23 of the clip 17 extends very approximately perpendicularly from the surface 15 of the container 1, as a first cantilever portion. A second portion 23*b* of the first part 23 of the clip extends very approximately perpendicularly from the first portion 23*a* as a second cantilever portion that extends over the surface 15 (and spaced apart from the surface 15). The first part 23 of the clip 17 may be regarded as having a distorted "S-bend" profile. The second part 25 of the clip 17 extends from the free end region 27 of the first part 23 with a single curve profile. At its closest approach to the plane of the surface 15, the second part 25 is closer to the plane of the surface than is the closest approach of the second portion 23*b* of the second part of the clip. For example, the closest approach of the portion 23*b* may lie approximately in the plane of the surface 15 (or 1-2 mm or less spaced therefrom), whereas the closest approach of the second part 25 may be approximately 3-8 mm (or greater) from the plane of the surface 15.

Also shown in FIG. 2 are reinforcing ribs 28 that support the upright portions 23*a* of each clip 17, and cut-outs 30 in the surface 15 adjacent to where the portions 23*a* meet the surface 15, to reduce stress concentrations at these regions.

Figure 3A:
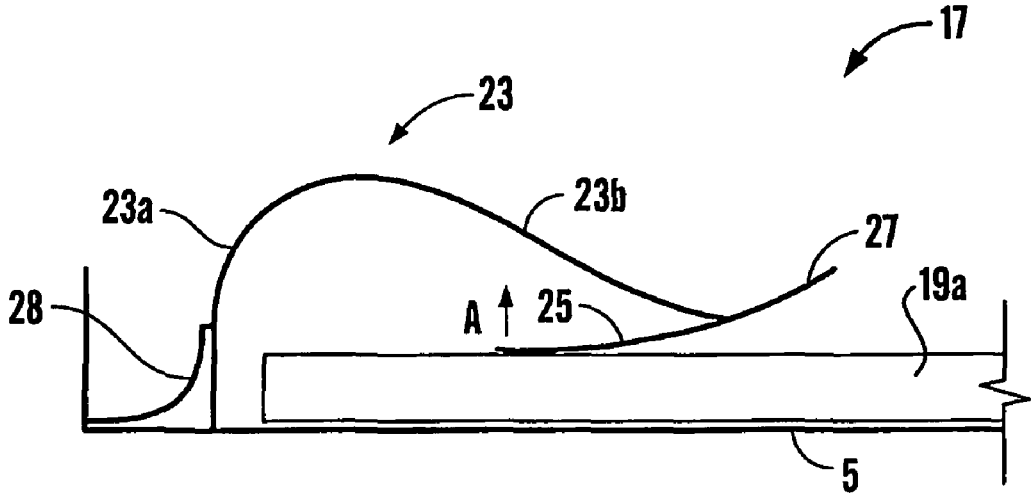
FIG. 3 (views (a) and (b)) shows, schematically, how a preferred embodiment of a clip according to the invention can hold differing sizes of object.
Figure 3B:
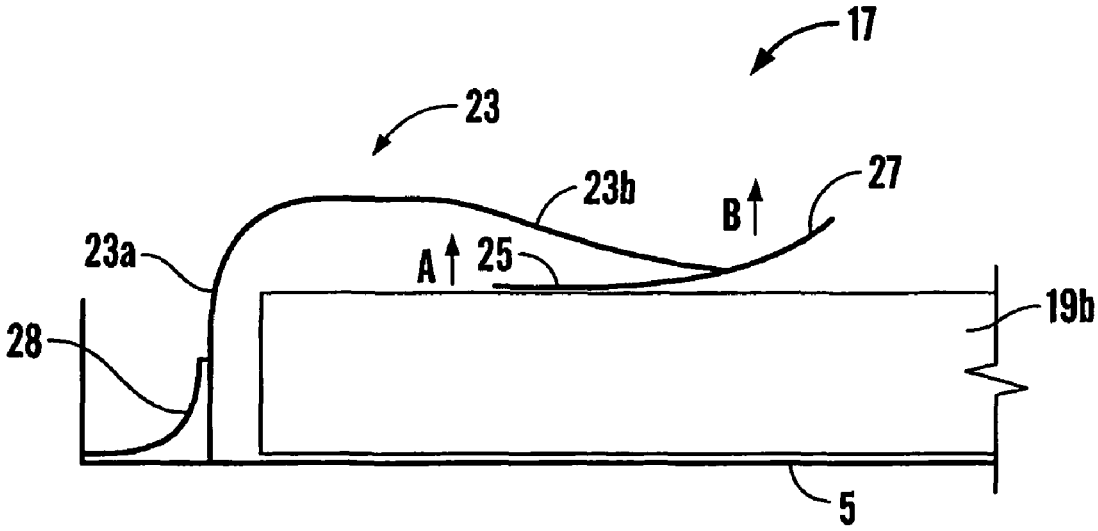

The functioning of the clips 17 of FIGS. 1 and 2 in holding different thicknesses of booklets 19 is shown in FIG. 3, views (a) and (b). In FIG. 3 (*a*), a relatively thin booklet 19*a* is retained on the surface 15 of the lid 5 of the container, by a clip 17. Because the booklet 19*a* is relatively thin (i.e. it has a thickness in a range referred to herein as a "second thickness") it is retained by the resilience of the second part 25 of the clip. Specifically, the second part 25 of the clip has been flexed away from the surface 15 slightly, as indicated by arrow A. The resilience of the second part 25, which is provided at least to a degree by the resilience of the end region 27 of the first part 23 from which the second part extends, causes the second part 25 to grip the booklet and to hold it in place. There will also be some deflection of the end region 27 of the first part 23 of the clip.

In FIG. 3(*b*), a thicker booklet 19*b* is retained in place by the clip 17. The thicker booklet has a thickness in a range referred to herein as a "first thickness", which is sufficient to cause the first part 23 of the clip 17 to flex away from the surface 15, as indicated by arrow B. The resilience of the first part 23 causes the first part 23 to grip the booklet and to hold it in place. Additionally, in order to accommodate the thicker booklet 19*b*, the second part 25 has also been flexed away from the surface 15 (and to move away from the surface 15 due to the movement of the first part 23 which carries the second part 25) as indicated by arrow A. Consequently, the booklet 19*b* is held both by means of the first part 23 and by means of the second part 25 of the clip 17, but primarily by means of the first part 23.

The invention claimed is:

1. A container comprising:

a surface; and at least one literature clip integrally molded with said surface for receiving and holding both relatively thin literature booklets and relatively thick literature booklets inserted between the clip and the surface, wherein the clip comprises a first resilient part mounted to the surface and extending over the plane of said surface in a first direction, said first resilient part comprising a first portion extending approximately perpendicularly from said surface, a second resilient part mounted at one end to the first resilient part and extending between the first resilient part and the plane of said surface in a second direction generally opposite to the first direction, said first resilient part defining a clip aperture disposed above said second resilient part and having a shape substantially similar to said second resilient part;

wherein said surface defines a surface aperture disposed beneath said first resilient part and having a shape substantially similar to said clip;

wherein, in a relaxed state, at least part of the second resilient part lies closer to the plane of said surface than the first resilient part;

wherein, when a relatively thin booklet is inserted between the clip and said surface, the second resilient part is deflected to an extent such that a face of the booklet is engaged by only the second resilient part;

wherein, when a relatively thick booklet is inserted between the clip and said surface, the second resilient part is deflected to an extent that a face of the booklet is engaged by both the first and second resilient parts; and wherein said clip allows said relatively thin or relatively thick booklet to slide into and out of engagement with said clip along said surface.

2. A container according to claim 1, in which the second part extends from an end region of the first part.

3. A container according to claim 2, in which the end region of the first part is a free end region thereof.

4. A container according to claim 1, in which the first and second parts extend in generally opposing directions to each other.

5. A container according to claim 1, in which, to hold an object having a first thickness, the first and second parts move resiliently as a unit.

6. A container according to claim 1, in which the container is a container for data storage media.

7. A container according to claim 1, in which the clip is attached to the surface via the first part of the clip.

8. A container according to claim 7, in which the clip is not attached to the surface via the second part of the clip.

9. A container according to claim 1, in which the second part, and at least a portion of the first part, of the clip, extend over a plane defining said surface.

10. A container according to claim 9, in which the portion of the first part of the clip comprises a cantilever extending over said surface.

11. A container according to claim 1, in which at least some of the resilience of the second part is provided by a region of the first part from which the second part extends.

12. A container according to claim 1, in which a literature booklet having a said first thickness is held by the resilience of both the first and second parts of the clip.

13. A container as claimed in claim 1 adapted to hold relatively thin literature booklets comprising a single or double sheet of paper or having a thickness in the range 1-2 mm and adapted to hold relatively thick literature booklets having a thickness in the range 3-8 mm or greater.

14. A container as claimed in claim 13 adapted to hold relatively thick literature booklets having a thickness up to 15 mm.

15. A container as claimed in claim 1, wherein said first part comprises a first portion and a second portion, and the first portion extends approximately perpendicularly from said surface.

16. A container as claimed in claim 15, wherein the second portion extends approximately perpendicularly from the first portion and extends over and is spaced apart from said surface.

* * * * *